US006073350A

United States Patent [19]

Elston et al.

[11] Patent Number: 6,073,350

[45] **Date of Patent: *Jun. 13, 2000**

[54] BLADESET FOR HAIR CLIPPERS INCLUDING BLADE WITH HAIR EVACUATION CONFIGURATION

[75] Inventors: Andrew Elston; Gregory S. Wahl, both of Sterling, Ill.

[73] Assignee: Wahl Clipper Corporation, Sterling, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/694,991

[22] Filed: Aug. 9, 1996

[51] Int. Cl.[7] ..... B26B 19/06

[52] U.S. Cl. ..... 30/216; 30/223; 30/225

[58] Field of Search ..... 30/210, 216, 223, 30/225, 233.5

[56] References Cited

U.S. PATENT DOCUMENTS

| | | | |
|---|---|---|---|
| D. 251,621 | 4/1979 | Mestrovic et al. . | |
| 1,780,276 | 11/1930 | Scheiwer . | |
| 1,908,385 | 5/1933 | Wahl . | |
| 1,939,253 | 12/1933 | Dremel . | |
| 2,008,631 | 7/1935 | Udkovich . | |
| 2,035,632 | 3/1936 | Andis . | |
| 2,118,850 | 5/1938 | Marcel . | |
| 2,264,101 | 11/1941 | Strezoff . | |
| 2,274,924 | 3/1942 | Hill | 30/225 |
| 2,292,364 | 8/1942 | Cromonic . | |
| 2,470,287 | 5/1949 | Carter . | |
| 2,641,833 | 6/1953 | Need . | |
| 2,713,718 | 7/1955 | Hudson | 30/210 |
| 2,726,441 | 12/1955 | Brody . | |
| 2,790,283 | 4/1957 | Spencer . | |
| 3,060,573 | 10/1962 | Clark . | |
| 3,391,459 | 7/1968 | Rollo . | |
| 3,571,928 | 3/1971 | Willey et al. . | |
| 3,999,295 | 12/1976 | Du Bois . | |
| 4,118,863 | 10/1978 | Sandy . | |
| 4,221,049 | 9/1980 | Hamashima . | |
| 4,328,616 | 5/1982 | Andis | 30/225 |
| 4,557,050 | 12/1985 | Haraguchi et al. . | |
| 4,782,592 | 11/1988 | Altamore . | |

FOREIGN PATENT DOCUMENTS

| | | |
|---|---|---|
| 70103 | 10/1949 | Denmark . |
| 586500 | 10/1933 | Germany . |
| 591709 | 8/1947 | United Kingdom . |
| 786505 | 11/1957 | United Kingdom . |
| 1136330 | 12/1968 | United Kingdom . |
| 2007575 | 5/1979 | United Kingdom . |
| 1552752 | 9/1979 | United Kingdom . |
| 2094698 | 9/1982 | United Kingdom . |

*Primary Examiner*—Douglas D. Watts
*Attorney, Agent, or Firm*—Greer, Burns, & Crain Ltd

[57] ABSTRACT

A blade is provided for use in a hair clipper having a bladeset including a moving blade and a stationary blade, the bladeset being constructed and arranged so that the moving blade is pressed against the stationary blade for allowing the moving blade to reciprocate relative to the stationary blade in a transverse direction to a longitudinal axis of the clipper. The blade includes a base portion having a tooth end, and a mounting end opposite the tooth end, a plurality of teeth arranged in spaced, parallel relationship to each other and projecting from the tooth end, each tooth having a tip and a root opposite the tip and being joined to the tooth end. The roots are joined to the tooth end in spaced relationship to each other to define generally planar-floored channels between the roots for facilitating the evacuation of hair and/or hair clippings from a cutting area of the bladeset. Also, the teeth have a constant rake angle at least from the tip to the root, and the base portion defines a transverse hump area of constant radius designed for further facilitating the evacuation of hair and/or hair clippings from the cutting area.

21 Claims, 4 Drawing Sheets

BLADESET FOR HAIR CLIPPERS INCLUDING BLADE WITH HAIR EVACUATION CONFIGURATION

RELATED APPLICATION

This application is related to commonly assigned, copending U.S. Ser. No. 08/738,757, filed Jul. 17, 1996 for IMPROVED CUTTING BLADE FOR HAIR CLIPPER.

BACKGROUND OF THE INVENTION

This invention relates to bladesets for hair clippers, and more particularly, to clipper bladesets including a reciprocating moving cutting blade and a stationary blade upon which the moving blade reciprocates, and wherein at least one of the blades is provided with a configuration which promotes the evacuation of hair clippings and/or hair from the cutting area of the bladeset, and facilitates the flow of hair away from the cutting area.

Electric hair clippers are well known in the art, and generally include a bladeset having a stationary blade and a moving blade. Each of the blades has a row of spaced teeth arranged so that hair strands which enter between the teeth of the stationary blade are cut when the teeth of the moving blade pass across the stationary blade teeth.

A common drawback of conventional hair clippers is that the hair clippings generated from the cutting action of the blades collect in the cutting area of the blades and become caught and/or clogged between the blades. As the hair clippings accumulate in the cutting area, a process which is exacerbated when cutting wet hair, the cutting action of the blades is impaired. Also, the subject's hair still attached to the scalp may also become clogged, snagged, or impair the operation of conventional clipper blades.

One attempt to solve this problem has been to mill or machine v-shaped grooves between the teeth of the stationary blade. Due to the shortcomings of conventional milling and machining techniques, these grooves tend to act like a funnel and do not provide sufficient avenues for escape of the hair and/or hair clippings. Thus, there is a need for a hair clipper bladeset which effectively facilitates the evacuation of a significant portion of hair and/or hair clippings from the cutting area of the bladeset.

Another drawback of conventional bladesets is the configuration of the individual teeth, which is also due in part to the limits of available milling or grinding technology. By design, each tooth has a designated rake angle, or the angle of slope of the side of the tooth from a relatively wide base or root, to a relatively narrow upper ridge or crown. The advantages of a large rake angle or a more gradual slope are that a sharper side edge is obtained, which is better for precise cutting. However, because of the narrow thickness of the blades, a larger rake angle results in a wider base for the tooth. Such a wider base makes it difficult for hair to feed through for cutting.

In addition, a sharper edged tooth is more easily damaged through use and dulls faster. Lastly, and again due to the relatively narrow thickness of the individual teeth, a larger rake angle results in a relatively narrow crown. Narrow crowns are easily damaged through normal manufacturing, and have been known to physically crumble or otherwise deteriorate due to insufficient thickness.

In the case of stationary blades, to promote the feeding of hair into the cutting area, the tip is desired to be thinner than the root, when viewed from above, and as such, the root is expected to be thicker than the tip. In addition, an overly thin root means that the rake angle cannot be too large, for fear of making the crown too thin and weak.

Thus, the decision of a specific, designed rake angle for a clipper tooth is a compromise of the above-listed factors. Even so, due to the limitations of conventional grinding, milling and machining technology, it is almost impossible to produce clipper teeth having the desired rake angle throughout a portion of their length near the cutting area, and also in the tooth height from base to crown. In fact, the rake angle of production teeth often varies depending on the point on the tooth where the angle is measured. This results in clipper teeth with less than optimal performance characteristics.

Accordingly, a first object of the present invention is to provide an improved blade for a hair clipper bladeset which is designed to prevent the accumulation and clogging of hair and/or hair clippings in the cutting area, which promotes the evacuation of clippings from the cutting area and promotes the flow of the user's remaining hair away from the blades.

Another object of the present invention is to provide an improved blade for a hair clipper bladeset which has a uniform rake angle at least along its length in the cutting area.

Still another object of the present invention is to provide an improved bladeset for a hair clipper in which the teeth of the stationary blade are configured to prevent pinching of the skin.

SUMMARY OF THE INVENTION

The above objects are met or exceeded by the present bladeset for a hair clipper, in which the blade teeth are arranged on the blade base to facilitate the passage of hair and/or hair clippings away from the cutting area. Each tooth has a root which is disposed on the blade in spaced relationship from the adjacent teeth by a generally planar channel. This channel defines a space through which the hair and/or hair clippings may more freely flow than in prior stationary blade configurations. In addition, each tooth is provided with backstriping which further defines the widened planar channel, and promotes the passage of hair and/or hair clippings away from the cutting area so that the blades are not clogged with hair. Also, each tooth has a uniform rake angle along its length in the cutting area, as well as along a desired portion of its height. Another feature of the present bladeset is that the blade has teeth which are fully radiused except for the cutting blade edges to prevent pinching or snagging of the skin.

More specifically, a blade is provided for use in a hair clipper having a bladeset including a moving blade and a stationary blade, the bladeset being constructed and arranged so that the moving blade is pressed against the stationary blade for allowing the moving blade to reciprocate relative to the stationary blade in a transverse direction to a longitudinal axis of the clipper. The blade includes a base portion having a tooth end, and a mounting end opposite the tooth end, a plurality of teeth arranged in spaced, parallel relationship to each other and projecting from the tooth end in a direction parallel to the longitudinal axis of the clipper, each tooth having a tip, a root opposite the tip and being joined to the blade end. The roots are joined to the blade end in spaced relationship to each other to define generally open or planar-floored channels between the roots for facilitating the evacuation of hair and/or hair clippings from a cutting area of the bladeset, and the flowing of hair past the roots. The present bladeset also features a base with a constant radius portion or transverse hump, and a tapered tooth configuration on at least the stationary blade to further facilitate the evacuation of hair clippings.

DETAILED DESCRIPTION OF THE PREFERRED EMBODIMENTS

Figure 1:
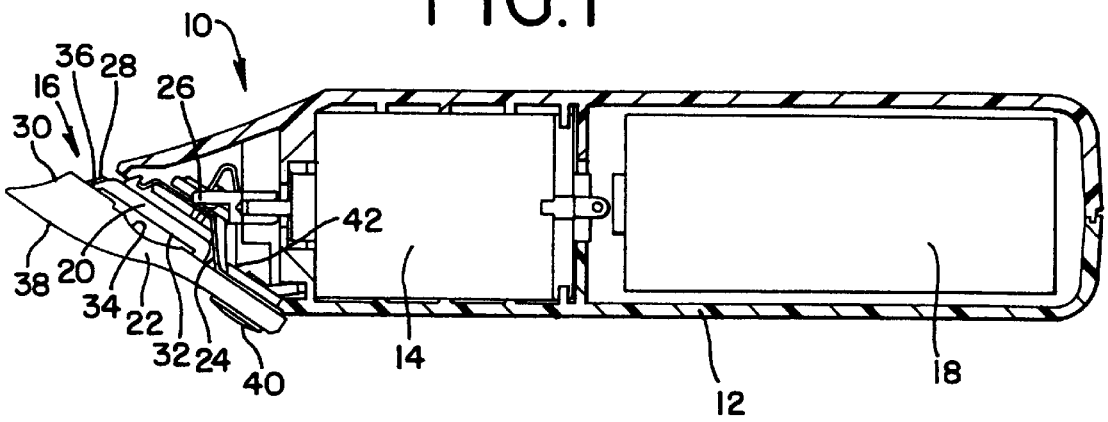
FIG. 1 is a vertical sectional view of a hair clipper of the type suitable for accommodating the present bladeset.

Referring now to FIG. 1, an electric hair clipper, generally designated 10 includes a case 12, a motor 14, and a bladeset generally designated 16. Electricity is supplied through a power supply 18, such as line voltage, batteries or the like.

The bladeset 16 includes a moving blade 20 and a stationary blade 22. The moving blade 20 is pressed against the stationary blade 22 by a tension spring 24, which allows the cutting blade 22 to be moved back and forth in a reciprocating motion in a transverse direction to a longitudinal axis of the clipper. Movement of the moving blade is performed by an eccentric cam 26 which is also coupled to the motor 14. A first set of teeth 28 are provided to the moving blade 20, and a second set of teeth 30 are provided to the stationary blade 22. An underside 32 of the moving blade 20 slidingly reciprocates relative to an upper surface 34 of the stationary blade 22 to define a cutting area 36 wherein hair caught between the blades is sheared by the action of the moving blade relative to the stationary blade, and the shearing action of the complementary teeth, as is well known in the art.

The stationary blade 22 on its underside 38 has a location for the head of at least one threaded fastener 40 which is used to secure a spring retention bracket 42 to the upper surface 34 and thus fasten the tension spring 24 to the stationary blade. In this manner, the moving blade 20 is retained to the stationary blade 22 to create the present bladeset 16, which is detachably retained upon the clipper 10 in a snap-fit arrangement to permit blade cleaning and replacement.

Figure 2:
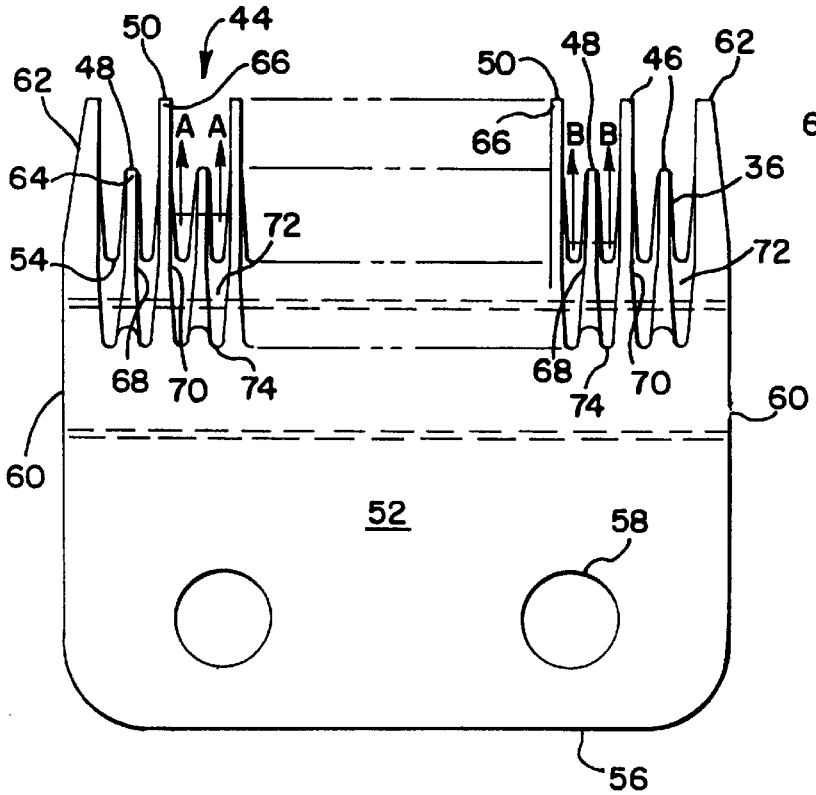
FIG.2 PRIOR ART
FIG. 2 is a bottom plan view of a prior art stationary blade of a clipper bladeset.
Figure 3:
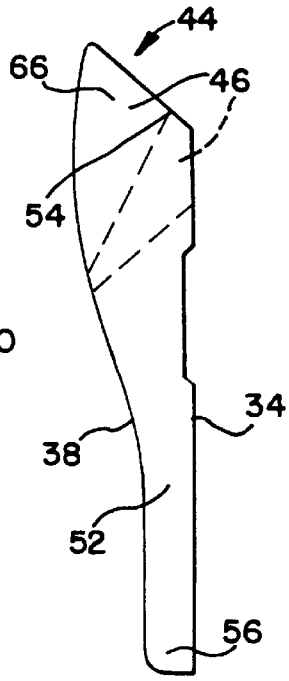
FIG.3 PRIOR ART
FIG. 3 is a side elevational view of the blade of FIG. 2.

Referring now to FIGS. 2 and 3, a prior art stationary blade, generally designated 44, also has an upper side 34 and a lower side 38 as does the blade 22. A linear row of teeth 46 includes a plurality of relatively short teeth 48, each such tooth located between a pair of relatively longer teeth 50 to create what is known in the art as a skip tooth blade. Skip tooth blades are typically used for cutting pet hair, and the wider space between adjacent longer teeth 50 allows thicker animal hair to be more easily drawn into the cutting area 36. The blade 44 is typically fabricated from a piece of steel using several stamping and/or machining steps which are well known in the art.

More specifically, the blade 44 includes a base portion 52 having a tooth end 54 provided with the teeth 46, and a mounting end 56 opposite the tooth end. At least one and preferably two mounting apertures 58 are disposed in the base portion 52 at the mounting end 56 and are each dimensioned to accommodate a fastener 40.

The blade 44 has a pair of outer edges 60, and the plurality of longer teeth 50 includes a pair of outermost end teeth 62 each of which being located adjacent a corresponding one of the outer edges 60, and each of the teeth 62 has a transverse thickness which is thicker than a corresponding thickness of the remaining long teeth. Each tooth 48, 50 has a tip 64, 66 and a root 68, 70, respectively, the roots being located opposite the tips and being the point at which the tooth engages the base portion 52. In the prior art blade 44, it is evident that both the shorter teeth 48 and the longer teeth 50 are generally thicker at the roots 68, 70 than at the tips 64, 66. Another common feature of such teeth 46 is that the longer teeth 50 have tips 66 which are thinner in cross-section and more lanceolate in shape when viewed from the side (best seen in FIG. 3) in order to more easily pass through hair and to draw hair into the cutting area 36.

An early attempt at facilitating the evacuation of hair clippings from the cutting area 36 is clearly seen in FIG. 2. At the roots 68, 70 of the teeth 46 is located a v-shaped groove 72 which extends from the tooth end 54 to rear ends 74 of the teeth 46. In manufacturing the blade 44, the grooves 72 are typically created by machining. It has been found in practice that this type of groove is unsatisfactory in the evacuation of hair clippings from the cutting area 36. As such, the cutting area becomes easily clogged, which requires the operator to take time to clean the blades fairly frequently.

Figure 2A:
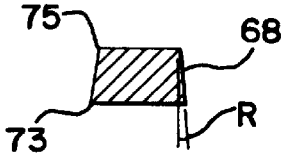
FIG. 2A is a cross-section taken along the line A—A of FIG. 2 and in the direction indicated generally.
Figure 2B:
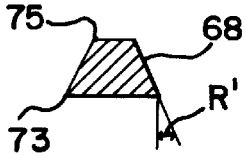
PRIOR ART FIG.2B
FIG. 2B is a cross-section taken along the line B—B of FIG. 2 and in the direction indicated generally.

Referring now to FIGS. 2A and 2B, cross sections of teeth 46 are depicted at two points. Each tooth has a rake angle R, which is a measure of the slope of the tooth from its base 73 to its crown 75. A drawback of prior art clipper blades such as the blade 44 is that the rake angle R varies throughout a portion of the length of the tooth near the cutting area 36. This variation, which is the result of conventional grinding, machining and milling technology, alters the performance of the blade and deviates from the blade's design parameters. It will be seen that the angle R in FIG. 2A is smaller than the angle R' in FIG. 2B. Also, the portion of the tooth in FIG. 2B has a wider base 73 relative to its crown 75 when compared to the portion of the tooth in FIG. 2A. The relatively narrower crown 75 in FIG. 2B will be more prone to damage or structural deterioration during manufacturing than the crown 75 in FIG. 2A. Among other things, this disparity in rake angle will result in a condition where the portion of the blade represented by FIG. 2A will be less sharp than that of FIG. 2B.

Referring now to FIGS. 4–7, the blade of the present invention is shown in greater detail. It will be seen that the stationary blade 22 is described as incorporating the features described below. However, it is contemplated that these features may also be incorporated into the moving blade 20.

The blade 22 is designed specifically to overcome the drawbacks of the prior art blade 44 relating to the problem of the evacuation of hair clippings from the cutting area 36. Generally speaking, many of the features to be discussed below are made possible by the manufacture of the blade 22 by injection molding, rather than the prior machining techniques. Although injection molding is commonly associated with plastics, from which the present blade 22 may be manufactured, it is contemplated that the blade 22 is made of injection molded metal.

In that the blade 22 shares many basic elements with the blade 44, the shared elements will be designated with identical reference numbers. As such, the blade 22 includes a base portion 52 having a tooth end 54, a mounting end 56 opposite the tooth end, and at least one and preferably two mounting apertures 58. A pair of outer edges 60 are also found on the blade 22.

In overall tooth configuration, the blade 22 also shares a basic similarity in with the blade 44, however, one of the features of the present blade 22 is that the teeth 30 have been reconfigured to maximize the evacuation of hair and/or hair clippings from the cutting area 36, and also to minimize pulling or snagging of the skin, the latter being a frequent occurrence with prior clippers.

In the present blade 22, the teeth 30, which also each have a base 73 and a crown 75, include a plurality of short teeth 76, and a plurality of long teeth 78 being arranged on the blade in spaced, parallel, skip tooth fashion whereby each of the short teeth has one of the long teeth on either side. The teeth 76, 78 project from the tooth end 54 in a direction parallel to the longitudinal axis of the clipper 10. Each of the short and long teeth 76, 78 have a corresponding tip 80, 82, as well as a corresponding root 84, 86. In similar fashion to the blade 44, the teeth 76, 78 also have a rear end 74.

A major feature of the present blade 22 is that the roots 84, 86 are joined to the tooth end 54 in spaced relationship to each other to define a plurality of generally planar-floored channels 88 between the roots for facilitating the evacuation of hair clippings from the bladeset 16.

Figure 4:
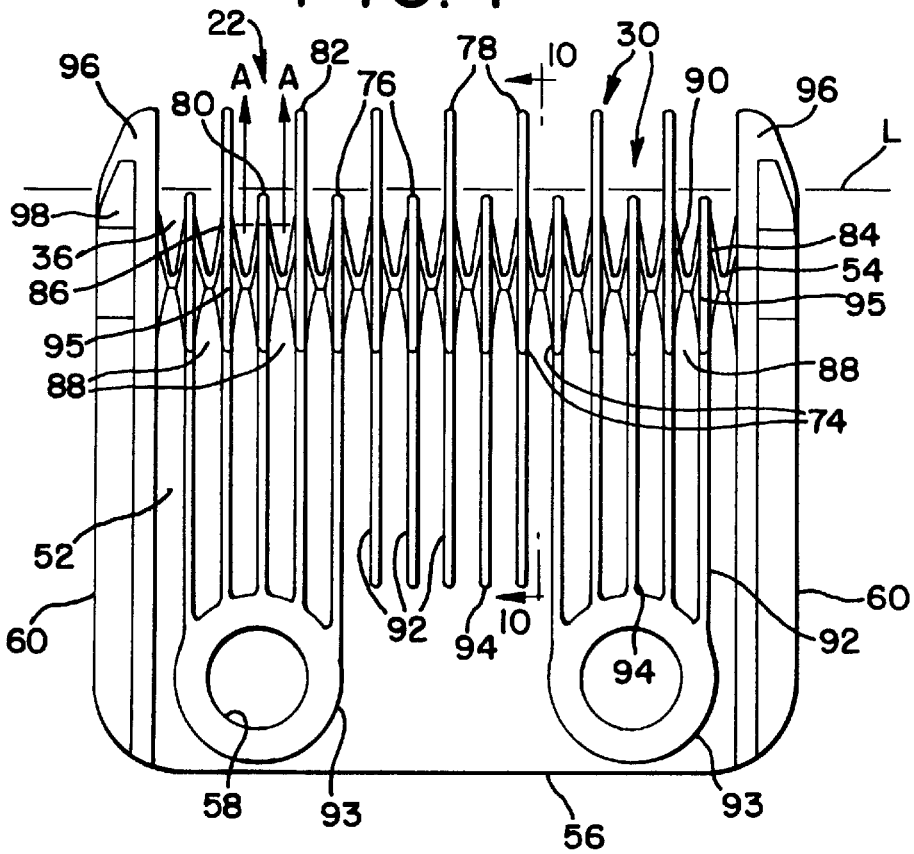
FIG. 4 is a bottom plan view of the stationary blade of the present bladeset.
Figure 6:
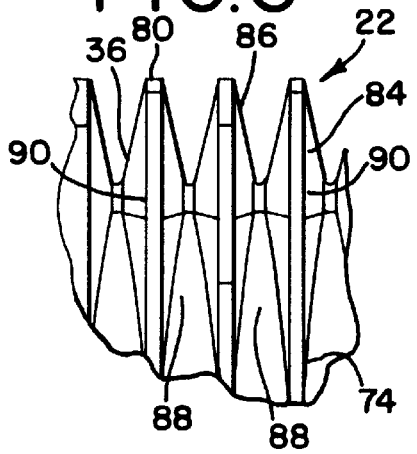
FIG. 6 is an enlarged fragmentary bottom plan view of the blade as shown in FIG. 3.
Figure 7:
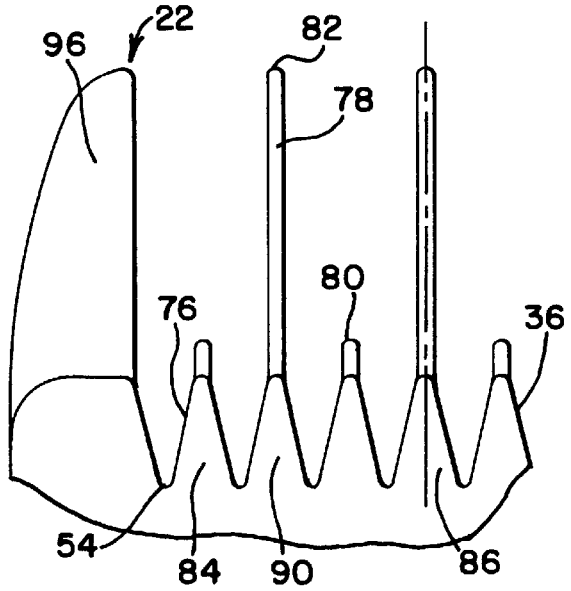
FIG. 7 is enlarged fragmentary top plan view of the stationary blade of FIG. 3.

Referring now to FIGS. 4 and 6, it will be seen that the root 84, 86 of each tooth 76, 78 tapers along the tooth length from a broad portion 90 adjacent the edge of the tooth end 54 toward the relatively narrower tips 80, 82. Similarly, each root 84, 86 also tapers from the broad portion 90 toward the mounting end 56. This latter tapering also opens up or widens the channels 88 toward the mounting end 56 to facilitate the evacuation of hair clippings from the cutting area 36. As best seen in FIG. 4, in front of the line L, there is no contact between the moving blade teeth 28 and the stationary blade teeth 30. As a result, the tips 80 and 82 located beyond the line L are generally straight-sided to promote feeding of hair into the cutting area 36. To the rear of the line L, the teeth 76, 78 are provided with the above-mentioned tapered configuration to further facilitate the feeding of the hair into the cutting area 36.

Referring now to FIGS. 4, 6, 9 and 10, another feature of the present blade 22 is that each tooth 76, 78 is provided with backstriping in the form of a vertically depending (when the clipper 10 is in use) rib 92 which extends from the rear ends 74 of each of the teeth in a direction toward the mounting end 56. It is contemplated that the degree of backstriping may vary with the application, however, in the preferred embodiment, the backstriping extends substantially the entire length of the base portion 52 to a line defined by perimeters 93 of the mounting apertures 58. In addition, each of the backstriping ribs 92 is flush with the crown 75 of the corresponding tooth 30, and is radiused along its upper edge 94 to reduce pulling or snagging of the skin of the individual whose hair is being cut. The backstriping 92 further defines the channels 88 and further facilitates the evacuation of hair and/or hair clippings from the cutting area 36.

Figure 4A:
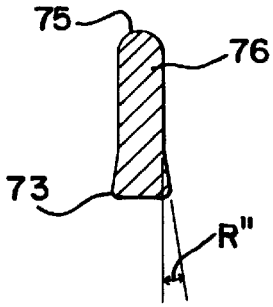
PRIOR ART FIG.4A
FIG. 4A is a sectional view taken along the line A—A of FIG. 4.
Figure 5:
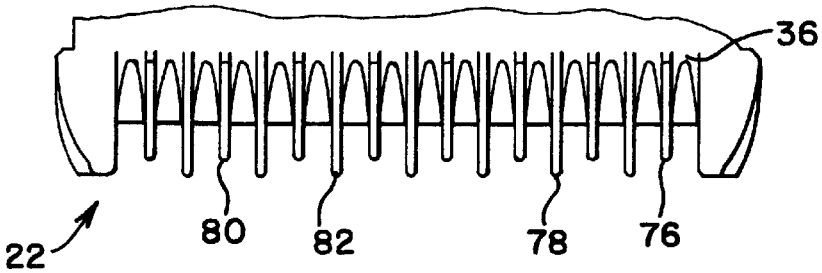
FIG. 5 is a fragmentary top plan view of the stationary blade of FIG. 3.

Still another feature of the present blade 22 is that the sides of the teeth 76, 78 have a constant rake angle R" (best seen in FIG. 4A), along a portion of their length (from the tips 80, 82 to the roots 84, 86) in the cutting area 36. The rake angle R" is measured at the base 73 of the teeth in the broad portion 90 near the cutting area 36. It will be seen in FIG. 4A that the rake angled portion only extends approximately ⅓ up the height of the tooth 76. This is because if the angle R" were maintained throughout the height of the tooth 76, a relatively narrow, sharp crown 75 would be defined. This type of tooth configuration is undesirable because of the tendency of sharp crowns to become easily damaged, or to structurally deteriorate during manufacture. In the present blade 22, a tooth configuration is achieved whereby the size of the rake angle R" is independent of the thickness of the tooth. In the tooth 76 as shown in FIG. 4A, the width or thickness of the crown 75 is greater than would be the case if the rake angle R" were maintained to the crown. The result is a tooth which has a fairly good rake angle compared to normal teeth, but still maintains adequate crown width. In one embodiment, the rake angle is 9°, however other angles are contemplated depending on the application.

Thus, in addition to a gradual opening of the channels 88 in a front-to-back dimension, by customizing the tooth profile, the blade 22 also defines a widening or opened space in a vertical direction away from the cutting area 36. Since the blade 22 is disposed on the clipper 10 so that the teeth 76, 78 face downward, this configuration encourages the hair and/or hair clippings to fall away from the cutting area 36.

Referring now to FIG. 4, at the outer edges 60 of the blade 22, one of the outermost end teeth 96 is located adjacent a corresponding one of the outer edges, and each of the outermost teeth have a transverse thickness which is thicker than a corresponding thickness of the other long teeth 78. This thickening is designed to provide protection, particularly impact protection, to the teeth located between the outermost teeth. In the present blade 22, each of the end teeth 96 defines a cut out shoulder region 98 with the corresponding edge 60 which provides the desired impact protection, yet minimizes weight.

Figure 9:
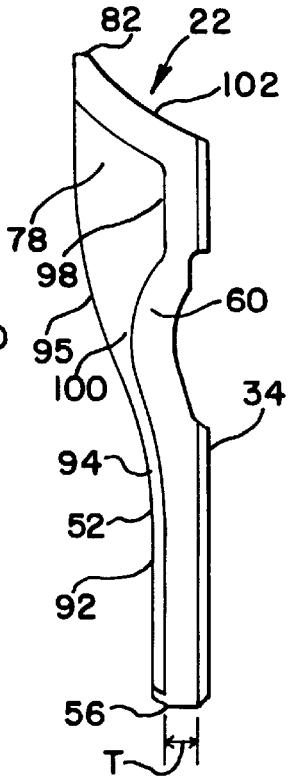
FIG. 9 is a side elevational view of the blade of FIG. 8.
Figure 10:
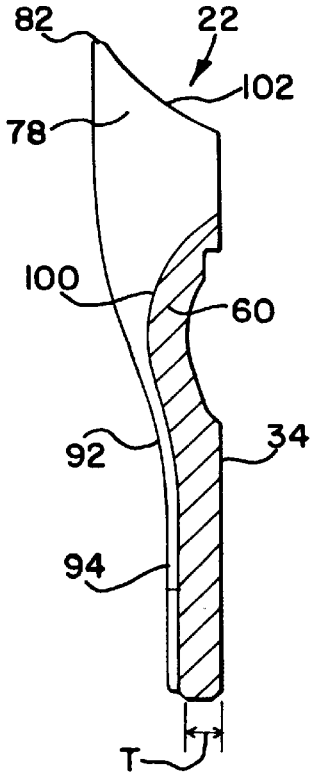
FIG. 10 is a sectional view taken along the line 10—10 of FIG. 4 and in the direction indicated generally.

Referring now to FIGS. 9 and 10, it will be seen that the base portion 52 of the blade 22 has a wall thickness T, which extends from the mounting end 56 to the tooth end 54. In the preferred embodiment, the base portion 52 has a zone of constant radius beginning at the tooth end 54 to define a transverse hump 100. It is preferred that, due to injection molding considerations, the thickness T remains uniform throughout the base portion, including in the constant radius portion or hump 100.

An advantage of the hump 100 is that it promotes a smooth, flow-through action of hair being cut, and, by acting in concert with the channels 88, further facilitates the evacuation of hair clippings from the cutting area 36. In the preferred embodiment, the transverse hump 100 is disposed on the blade 22 nearer to the tooth end 54 than to the mounting end 56. The planar-floored channels 88 are substantially equally spaced from each other when measured at the hump. Naturally, it is contemplated that the position and shape of the hump 100 may be altered or even eliminated depending on the application of the blade 22. However, when a skip tooth blade 22 is used to cut animal hair, the presence of the hump 100 will prevent clogging due to the build-up of animal grease.

Figure 8:
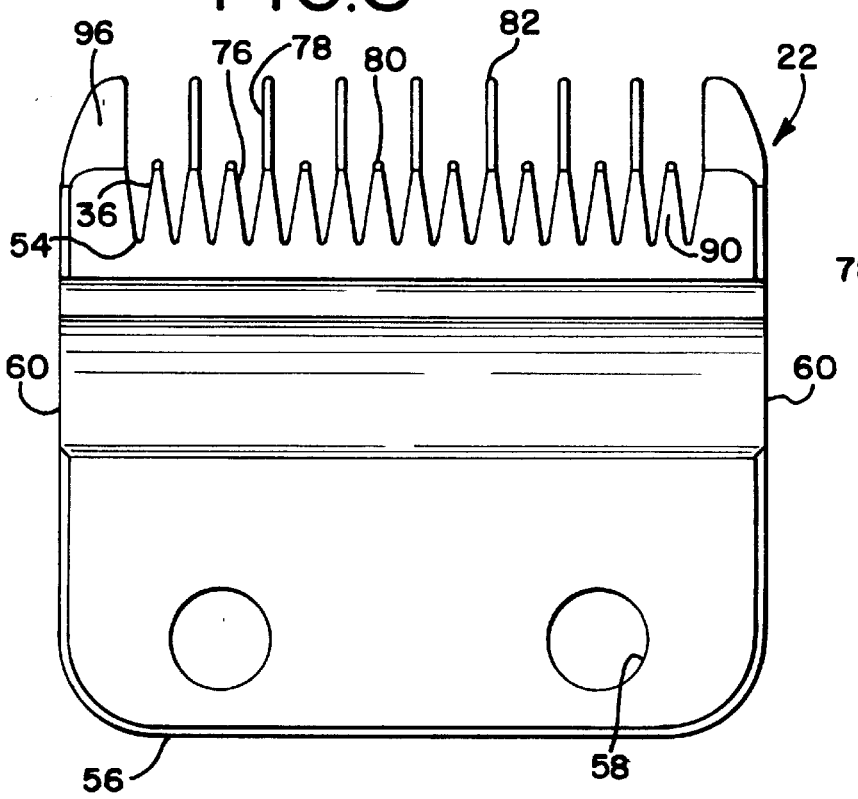
FIG. 8. is a top plan view of the present stationary blade.

Referring now to FIGS. 8–10, another feature of the blade 22 is that the tips 80, 82, as well as the crown 75, the upper backstriping 94 and all of the other edges of the teeth 76, 78, with the exception of the cutting edges, are radiused to minimize any pulling or snagging of the skin or scalp being cut, which occurred with prior art bladesets. In addition, a leading edge 102 of each of the long teeth 78 has a curved configuration when viewed from the side (best seen in FIG. 9) to facilitate the movement of the bladeset 16 through hair.

Figure 11:
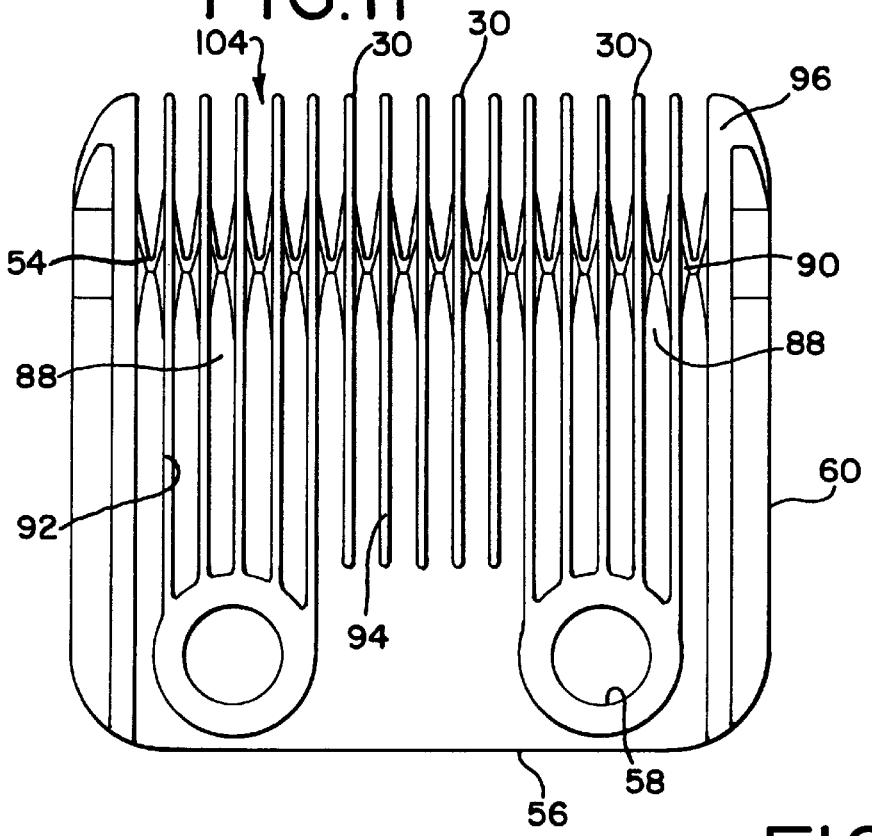
FIG. 11 is a bottom plan view of an alternate embodiment of the present stationary clipper blade.

Referring now to FIG. 11, an alternate embodiment of the blade 22 of FIG. 4 is shown and is generally designated 104. The main difference between the blade 104 and the blade 22 described above is that the blade 104 does not have a skip tooth configuration as does the blade 22. Instead, all of the teeth 30 have the same length. This type of blade is typically used for cutting human, as opposed to animal hair. All of the other components and features of the blade 22 are present in the blade 104, and have been assigned similar reference numbers.

Figure 12:
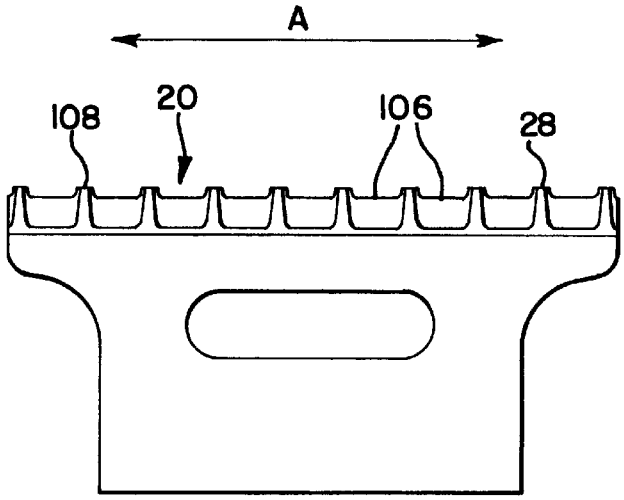
FIG. 12 is an overhead plan view of a moving blade which is suitable for use with the present bladeset.

Referring now to FIG. 12, the moving blade 20 suitable for use with the present fixed blade 22 is shown in greater detail. A knife-like edge surface 106 separates each of the moving blade teeth 28, and the edges are oriented in the direction of movement of the moving blade 20. A feature of the edges 106 is that they are capable of cutting some of the hair strands which enter between the stationary blade teeth 30. Spacing between adjacent teeth 28 is greater than the space between adjacent stationary teeth 30. The teeth 28 have flat tips 108, and are separated by the knife-like edge surfaces 106. The edges 106 are oriented in the direction A in which the moving blade reciprocates, and are sharp enough to cut a hair with a slicing action created by the moving blade, although actual razor sharpness is not needed.

Generally, the knife-like edge surfaces 106 cut hair strands as they would be cut with a knife using a slicing action, and the teeth 28 cut with a shearing action similar to a conventional hair clipper. It is contemplated that in some cases the teeth 28 only partially cut some of the hair strands. It is also contemplated that the present stationary blade 22 may be used with a conventional moving blade having a plurality of teeth without the sharpened edge surfaces 106, as are well known in the art.

In use, the hair clipper 10 is used in an ordinary manner. The long teeth 78, with their straight-sided tips and diamond-shaped portions near the cutting area 36 (when viewed from above, best seen in FIG. 6) help feed the hair into the cutting area, where the shearing action of the moving blade 20 relative to the stationary blade 22 generates hair clippings. A combination of features, including the planar-floored channels 88, the backstriping 92 and the transverse hump 100 create a structure where clogging or collecting of hair clippings is prevented, and instead, the hair clippings are easily evacuated from the cutting area 36.

In addition, when the bladeset 16 is equipped with a moving blade 20 which features the sharpened edge surfaces 106, the clipper 10 may be moved in a direction which allows the knife-like surfaces 106 to cut some hair strands, while the moving teeth 28 cut other hair strands. The angle of approach to the strands affects the rate of cutting by the moving blade. The teeth 28 do not cut the hair strands in exactly the same manner as the edges 42, however, which creates a new and unique clipper cut hairstyle similar in appearance to the style obtained with a razor. Other styles are also contemplated.

While a particular embodiment of the hair clipper bladeset of the invention has been shown and described, it will be appreciated by those skilled in the art that changes and modifications may be made thereto without departing from the invention in its broader aspects and as set forth in the following claims.

What is claimed is:

1. A blade for use as a stationary blade or a moving blade in a hair clipper provided with a bladeset including a moving blade and a stationary blade, the bladeset being constructed and arranged so that the moving blade is pressed against the stationary blade to allow the moving blade to reciprocate relative to the stationary blade in a transverse direction to a longitudinal axis of the clipper, said blade comprising:

a base portion having a tooth end, and a mounting end opposite said tooth end;

a plurality of teeth arranged in spaced, parallel relationship to each other and projecting from said tooth end;

each said tooth having a tip, a root opposite said tip, and being joined to said tooth end;

said roots each having a broad portion adjacent said tooth end, and tapering from said broad portion toward said mounting end;

said roots joined to said tooth end in spaced relationship to each other said spaced relationship and said tapering of said teeth from said broad portion to said mounting end combining to define generally planar-floored channels between said roots which widen from said tooth end toward said mounting end for facilitating the evacuation of hair clippings from the bladeset and the flowing of hair past said roots.

2. The blade as defined in claim 1 wherein said base portion has a transverse portion of constant radius beginning at said tooth end.

3. The blade as defined in claim 2 wherein said blade portion has a wall thickness, and said thickness remains uniform throughout said blade portion, including said constant radius portion.

4. The blade as defined in claim 1 wherein said blade is configured to be the stationary blade of the bladeset.

5. The blade as defined in claim 1 wherein each of said teeth has backstriping.

6. The blade as defined in claim 5 wherein said backstriping extends at least substantially toward said mounting end of said blade.

7. The blade as defined in claim 1 wherein said teeth have a constant rake angle near a cutting area.

8. The blade as defined in claim 1 wherein said plurality of teeth includes a plurality of long teeth, and a plurality of short teeth, said pluralities of short and long teeth being arranged on said blade in skip tooth fashion whereby each of said short teeth has one of said long teeth on either side thereof.

9. The blade as defined in claim 1 wherein said base portion has a pair of outer edges, and said blade includes a pair of outermost end teeth, one of which being located adjacent a corresponding one of said outer edges of said base portion, said end teeth each having a transverse thickness which is thicker than a corresponding thickness of the remaining teeth, and wherein said end teeth each define a cut out shoulder region with said corresponding edge.

10. The blade as defined in claim 1 wherein all of the edges of said teeth are radiused except for cutting edges thereof.

11. The blade as defined in claim 1 wherein each said tooth has backstriping extending toward said mounting end, said backstriping of each tooth defining said planar-floored channels between said root and said mounting end.

12. A blade for use as a stationary blade or a moving blade in a hair clipper provided with a bladeset including a moving blade and a stationary blade, the bladeset being constructed and arranged so that the moving blade is pressed against the stationary blade to allow the moving blade to reciprocate relative to the stationary blade in a transverse direction to a longitudinal axis of the clipper, said blade comprising:

a base portion having a tooth end, and a mounting end opposite said tooth end;

a plurality of teeth arranged in spaced, parallel relationship to each other and projecting from said tooth end;

each said tooth of said plurality of teeth has a tip, a root opposite said tip and being joined to said tooth end, said roots each having a broad portion adjacent said tooth end, and tapering from said broad portion toward said mounting end;

said roots joined to said tooth end in spaced relationship to each other, said spaced relationship and said tapering of said teeth from said broad portion to said mounting end combining to define generally planar-floored channels between said roots which widen from said tooth end toward said mounting end;

said base portion having a portion of constant radius beginning at said tooth end to define a transverse hump for facilitating the evacuation and/or flow of hair and/or hair clippings away from the tooth end; and each said tooth of said plurality of teeth has backstriping extending toward said mounting end, said backstriping of each said tooth combining with said tooth construction to define said planar-floored channels between said root and said mounting end.

13. The blade as defined in claim 12 wherein said blade is configured to be the stationary blade of the bladeset.

14. The blade as defined in claim 12 wherein said teeth have a constant rake angle in a lower portion of the teeth in a cutting area so that the size of the rake angle is independent of the thickness of the teeth.

15. The blade as defined in claim 1 wherein each said tooth has a constant rake angle in a cutting area along its length from said tip to said root.

16. The blade as defined in claim 15 wherein the size of said rake angle of said tooth is independent of said thickness of said tooth.

17. The blade as defined in claim 15 wherein said tooth end has a portion of constant radius defining a transverse hump for facilitating the evacuation of hair clippings from said tooth end.

18. The blade as defined in claim 15 wherein said rake angle extends upward a portion of said teeth from a base to a crown.

19. The blade as defined in claim 1 wherein each said tooth has a constant rake angle in a lower cutting area from said tip to said root so that the size of said rake angle of said tooth is independent of a thickness of said upper end of said tooth.

20. The blade as defined in claim 1 wherein each said tooth has a constant rake angle in a cutting area from said root to said tip, said rake angle being predetermined and being accurately reproducible through the injection molding of said blade.

21. A blade for use as a stationary blade or a moving blade in a hair clipper provided with a bladeset including a moving blade and a stationary blade, the bladeset being constructed and arranged so that the moving blade is pressed against the stationary blade to allow the moving blade to reciprocate relative to the stationary blade in a transverse direction to a longitudinal axis of the clipper, said blade comprising:

a base portion having a tooth end, and a mounting end opposite said tooth end;

a plurality of teeth arranged in spaced, parallel relationship to each other and projecting from said tooth end;

each said tooth having a tip, a crown, a root opposite said tip, an upper end and being joined to said tooth end; and each said tooth having a constant rake angle only in a lower cutting area from said tip to said root so that the size of said rake angle of said tooth is independent of a thickness of said upper end of said tooth, and the thickness of said upper end is greater than would be the case if said rake angle were maintained to said crown.

* * * * *